US011019854B1

(12) United States Patent
Lee

(10) Patent No.: US 11,019,854 B1
(45) Date of Patent: Jun. 1, 2021

(54) SYSTEMS AND METHODS FOR PROVIDING A BODY COVER

(71) Applicant: Christina Hulme Lee, Salt Lake City, UT (US)

(72) Inventor: Christina Hulme Lee, Salt Lake City, UT (US)

( * ) Notice: Subject to any disclaimer, the term of this patent is extended or adjusted under 35 U.S.C. 154(b) by 47 days.

(21) Appl. No.: 16/179,668

(22) Filed: Nov. 2, 2018

(51) Int. Cl.
*A41D 11/00* (2006.01)
*A41B 13/06* (2006.01)
*A47G 9/06* (2006.01)

(52) U.S. Cl.
CPC ..... *A41D 11/00* (2013.01); *A47G 9/068* (2013.01); *A41B 13/06* (2013.01)

(58) Field of Classification Search
CPC ..... A47G 9/066; A47G 9/068; A47G 9/02; A47G 9/08; A47G 9/083; A47G 9/086; A47G 9/0223; A41D 11/00; A41D 13/02; A41D 13/04; A41D 2400/44; A41D 27/10; A41B 13/06
See application file for complete search history.

(56) References Cited

U.S. PATENT DOCUMENTS 2,146,400 A 2/1939 Maker et al.
2,707,988 A 5/1955 Shaub et al.
4,241,458 A 12/1980 Lesesne
4,363,141 A 12/1982 Doster
4,759,082 A 7/1988 Mulligan
4,901,371 A 2/1990 Christians
5,283,909 A 2/1994 Hill
5,437,061 A 8/1995 Kenner
6,055,686 A 5/2000 Knight
6,145,932 A 11/2000 Hamel-Nyhus et al.
6,209,953 B1 4/2001 Mackay et al.
6,401,248 B1 6/2002 Christensen
6,408,439 B1 * 6/2002 Garforth-Crippen ..... A41B 13/00 2/80
6,547,325 B2 4/2003 Drost et al.
6,643,870 B2 11/2003 Bertrand
6,948,200 B2 9/2005 Wyman
6,966,069 B2 11/2005 Booth
D527,562 S 9/2006 Manning
7,384,098 B1 6/2008 Allwin
D651,032 S 12/2011 Adkins
8,118,364 B2 2/2012 Davis
8,225,422 B1 7/2012 McSparron
D684,409 S 6/2013 Juarez
(Continued)

OTHER PUBLICATIONS https://www.coziewarmers.co.uk/POP-ON-Sleeved-Buggy--Car-Seat-Blanket--GREY-STARS, "Pop-On Sleeved Buggy/Car Seat Blanket" retrieved on Jan. 23, 2019.

*Primary Examiner* — Katherine M Moran
*Assistant Examiner* — Erick I Lopez
(74) *Attorney, Agent, or Firm* — David B. Tingey; Bryant J. Keller; Kirton McConkie

(57) ABSTRACT

This disclosure relates to apparel, clothing, and/or other body coverings. In particular, some implementations of the described systems and methods provide a body cover that is configured to cover a user's arms, legs, feet, and/or front side. In some cases, the covering's backside is configured to remain open such that the covering can easily be placed over a person while that person is in a car seat, a wheelchair, and/or any in any other suitable location. Other implementations are also described.

15 Claims, 14 Drawing Sheets

(56) References Cited

U.S. PATENT DOCUMENTS

| | | | | |
|---|---|---|---|---|
| D700,433 | S | 3/2014 | Ammar et al. | |
| 9,003,564 | B2 | 4/2015 | Wynh | |
| D741,567 | S | 10/2015 | Chang | |
| 9,380,816 | B2 | 7/2016 | Longfellow | |
| D800,994 | S | 10/2017 | Pos | |
| 2003/0061659 | A1 | 4/2003 | Dunlap et al. | |
| 2005/0200174 | A1 | 9/2005 | Morgan et al. | |
| 2007/0235480 | A1 | 10/2007 | Russo et al. | |
| 2008/0196141 | A1 | 8/2008 | Osborne et al. | |
| 2010/0170039 | A1* | 7/2010 | Davis | A47D 15/006 5/494 |
| 2014/0013509 | A1* | 1/2014 | Gravett | A47G 9/0223 5/494 |
| 2014/0165257 | A1 | 6/2014 | Wynh | |
| 2015/0250337 | A1 | 9/2015 | Gould | |

* cited by examiner

80

SYSTEMS AND METHODS FOR PROVIDING A BODY COVER

RELATED APPLICATIONS

This application claims priority to U.S. Provisional patent Application Ser. No. 62/580,981, entitled "CAR SEAT SOCK," filed Nov. 2, 2017, the entire disclosure of which is hereby incorporated herein by reference.

BACKGROUND OF THE INVENTION

1. Field of the Invention

This disclosure relates to apparel, clothing, and/or other body coverings. In particular, some implementations of the described systems and methods provide a body cover that is configured to cover a user's arms, legs, feet, and/or front side. In some cases, the covering's backside is configured to remain at least partially open such that the covering can easily be placed over a person in a car seat, a wheel chair, and/or any in any other suitable location.

2. Background

We live in a world where we are always on the go. In this regard, if we have babies, children, or toddlers, we often take them with us in car seats or strollers and in all kinds of weather. However, many studies have shown that it is not safe to have babies or toddlers wear coats in car seats. The bulkiness of the coat often prevents the straps of the car seat from being tight enough around the child to keep him or her safe. Even though the straps might feel tight to the parent, the fluff of the coat compresses in a crash, oftentimes leaving the straps loose enough for a child's body to slip out of the car seat, which can lead to ejection from the vehicle and/or other serious injury. In any case, it would be a parent's nightmare to put their child in a nice warm coat and carefully buckle them into his or her car seat, only to discover that the child was seriously injured or killed in an accident because the coat compressed from the force of the crash, leaving enough space between the child and the car seat straps to allow him or her to be thrown from the car seat!

To avoid the problems described above, there are some common alternatives for keeping children in car seats warm in cold weather. Indeed, many experts recommend buckling the child in the car seat and simply placing a blanket over the top of him or her. However, this can be a challenge for several reasons. First, a blanket is often so loose and free flowing that many babies or toddlers will simply kick it off within a matter of minutes, leaving them exposed to the cold. Second, babies and toddlers often do not hold their arms still for very long (unless they are asleep). This means that they could be easily frustrated by a blanket placed all the way over their body that does not allow them to move their arms. As a result, they may eventually push the blanket off. Some parents may try placing the blanket under the child's arms to cover just the chest and body area, but again, this may not keep the child sufficiently warm. Instead, it can leave the child's shoulders, arms, and hands without protection from the cold.

A third challenge with simply placing a blanket over the top of the child is that a blanket's position can easily shift around. As a result, even if the child does not kick the blanket off, the blanket can often leave gaps where either a leg or an arm is not covered completely. This can leave the child partially covered, but uncomfortable with the draft from the uncovered areas. When a child is small enough to be in an infant carrier, this also means that the blanket often dangles off of the car seat or even completely falls off onto the ground or the floor, including in doctor's offices, shopping centers, and other places in which the blanket can readily become dirty and covered in germs. Then, because the child still needs a blanket or cover of some sort, the blanket is often placed back on the child. As the blanket is now covered in dirt or germs, such germs can be passed to the child, including into the child's mouth, when the child is snuggled up in the blanket.

It can be frustrating for parents to know how to keep their children warm when they are out and about. Similar challenges exist for children who are carried in baby harnesses strapped to a parent's chest. In addition to children, infants, and toddlers, some of these same challenges exist for disabled children or adults who are required to be in wheelchairs or specific chairs or harnesses to hold them up.

Thus, while techniques currently exist that are used to keep children warm while in a car seat (or others warm while in a wheelchair or chair), challenges still exist, including those discussed above. Accordingly, it would be an improvement in the art to augment or even replace current techniques with other techniques.

SUMMARY

This disclosure relates to apparel, clothing, and/or other body coverings. In particular, some implementations of the described systems and methods provide a body cover that is configured to cover a user's arms, legs, feet, and/or front side. In some cases, the covering's backside is configured to remain at least partially open such that the covering can easily be placed over a person in a car seat, a wheel chair, and/or any in any other suitable location.

In accordance with some implementations, the described systems and methods include a body cover. While the described body cover can perform any suitable function, in accordance with some implementations, it can offer a solution to some of the problems created by children and others not being able to easily and/or safely wear coats in car seats. Indeed, in some cases, the described body cover (or covering) provides warmth for children, while still allowing them to be buckled tightly in their car seat straps because, in some cases, the blanket does not come between the straps and the children's bodies.

In some implementations, the described body cover is designed to not only provide warmth to its wearer (or the person wearing the body cover), but also to allow for easy movement of the wearer's arms and hands. In some cases, the body cover also has a "sock-like" pouch to keep the wearer's legs and feet warm. In some cases, the sleeves are designed to wrap around from a front side of the wearer's shoulders to the back side of the wearer's shoulders to provide extra warmth and to prevent the wearer from pushing or kicking the body cover off.

Additionally, some implementations of the described body cover wrap almost completely around at least a portion of its wearer's legs and feet, so as to keep them warm, cozy, and covered. In some instances, the described body cover helps avoid the awkwardness of blankets that can easily move around in their positioning or that can be easily kicked off. Moreover, some implementations of the body cover are designed to be quick and easy to put on or take off, which helps cover a child in a relatively short period of time. Indeed, in some cases, the described body cover can easily be removed to prevent overheating if its wearer becomes warm enough that the product is no longer needed. In fact, in some cases, the body cover can simply be pulled off of the child in a car seat, without needing to unstrap the child at all.

With its warm and cozy protective design, some implementations of the described body cover are also ideal for use in a stroller. In this regard, a parent can enjoy the comfort of knowing something warm has been wrapped around their child while the parent is walking or jogging with the child in the stroller. In so doing, the parent will not have to worry about the body cover constantly slipping off or getting caught in the stroller wheels or dragging on the ground. Additionally (and as mentioned above), some implementations of the body cover allow a child (or other wearer) to easily move his or her arms and hands while they are riding. Moreover, as some implementations of the body cover optionally comprise integrated hand covers (e.g., wrap around hand covers, mittens, gloves, and/or any other suitable hand covers) the cover can be used to ensure that its wearer's hands stay warm.

In accordance with some implementations, the body cover comprises one or more pockets. In some such implementations, the body cover comprises one or more front pockets that give the wearer or others (e.g., parents) a great place to store a binky, toys, snacks, and/or other suitable items. While the pockets can be of any suitable shape and size and have any suitable feature, in some cases, the cover comprises a side-access pocket that gives the wearer easy access to the pocket's contents.

In some cases, the described body cover is configured to cover a front portion of a person wearing the cover, while leaving a back portion of the wearer uncovered. With such a covered-front and open-back design, some implementations of the cover are ideal for use over a child in a car seat or over the straps of a baby harness that is attached to a parent's chest. Indeed, in some cases, a child can be buckled safely in the baby harness and then covered by the body cover—allowing the child to still use his or her arms, while having the child's legs be covered, and the child's back stay warm because the child is up against its parent's chest.

Thus, some implementations of the body cover are ideal for outings when parents will need a car seat, a stroller, and/or a baby harness. Indeed, the child can use this product in the car seat for the drives to a location. Once the child arrives, the child can then wear the cover while buckled into a stroller and/or a baby harness.

In addition to using the described body cover for babies and toddlers, some implementations of the cover can be used with people of any size and age. Indeed, some embodiments of the body cover are configured to cover: children or adults in wheelchairs, people sitting in cars, people who are wearing straps snugly against their bodies, people on carriage rides, and/or people in any other situation in which some implementation of the body cover may keep them warm when they are in cold places. For instance, older kids, teens, and even adult passengers in cars could enjoy the warmth and comfort the cover provides. Similarly, some implementations of the cover are useful for spectators at outdoor sporting events when they need to be able to keep their arms free and feet warm.

In some cases, instead of and/or in addition to keeping a person warm, the described body cover is configured to keep a person wearing the cover relatively clean. Indeed, in some embodiments, the cover comprises a layer of a polymer, a microfiber material, and/or other suitable material that is configured to be wiped clean relatively easily. Thus, some such embodiments can be useful for children's highchairs, feeding children at the table, feeding children in a car seat, for babies that spit up, and/or for a variety of other applications.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which:

FIGS. 6A-6H illustrate plan views of different pattern pieces of some representative embodiments of the body cover, wherein FIG. 6A illustrates a pattern for a representative embodiment of a main body of the body cover, FIG. 6B illustrates a pattern for a representative embodiment of a back side of a foot pouch of the body cover, FIG. 6C illustrates a pattern for a representative embodiment of a sleeve with a fold-down hand cover, FIG. 6D illustrates a pattern for a representative embodiment of a sleeve without a fold-down hand cover, FIG. 6E illustrates a pattern for a representative embodiment of a pocket of the body cover, FIG. 6F illustrates a pattern for a representative embodiment of a collar of the body cover, FIG. 6G illustrates a pattern for a representative embodiment of a collar with an angled edge for use with the body cover, and FIG. 6H illustrates a pattern for a representative embodiment of a collar having a rounded edge for use with the body cover.

DETAILED DESCRIPTION OF THE INVENTION

This disclosure relates to apparel, clothing, and/or other body coverings. In particular, some embodiments of the described systems and methods provide a body cover that is configured to cover a user's arms, legs, feet, and/or front side. In some cases, the covering's backside is configured to remain at least partially open such that the covering can easily be placed over a person in a car seat, a wheel chair, and/or any in any other suitable location.

Indeed, in accordance with some embodiments, the described body cover is configured to be placed on a user, even when that user is already sitting down, lying down, strapped in a baby harness, and/or in any other suitable location. Indeed, in some cases, the body cover is configured to be placed on a user at any suitable time, and when the user is in any suitable location or position, including, without limitation, when the user is in an infant car seat, a highchair, a wheelchair, a hospital bed, a hammock, a bed, a chair, a couch, in a baby carrier, and/or in any other suitable location.

Figure 1:
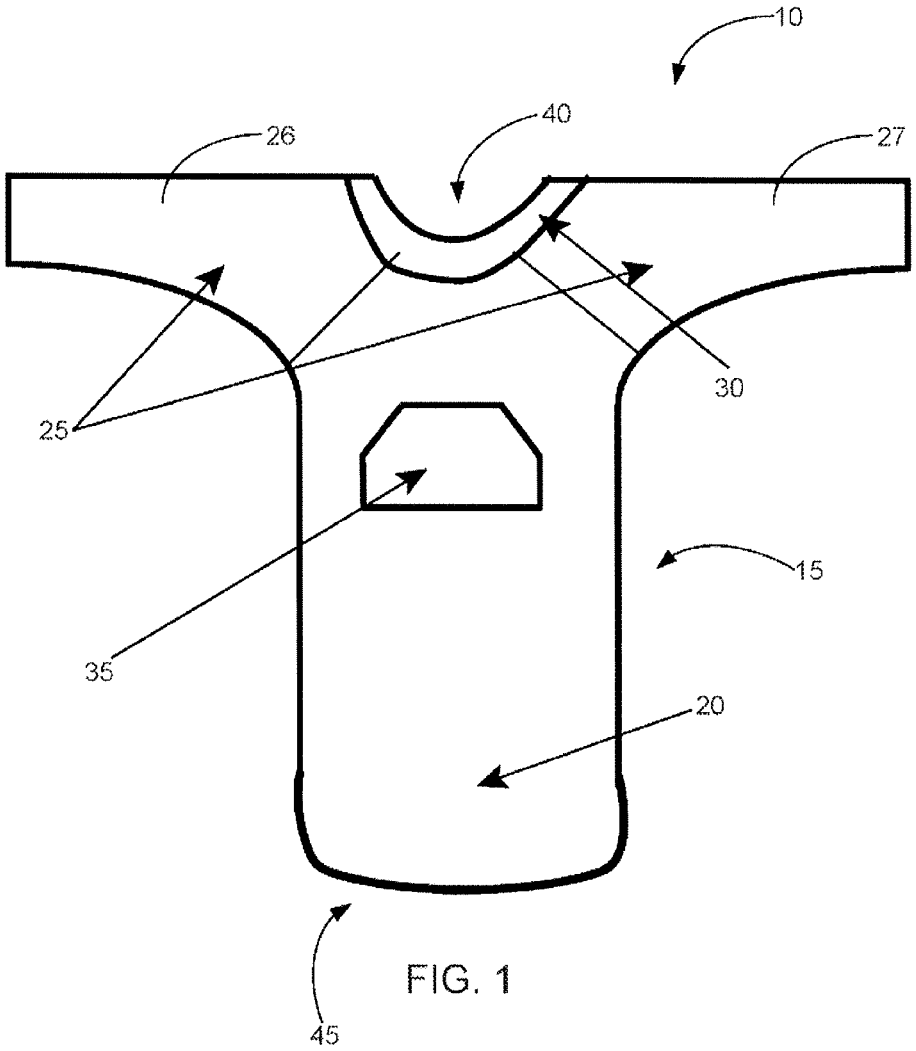
FIG. 1 illustrates a front side view of a representative embodiment of a body cover.
Figure 2:
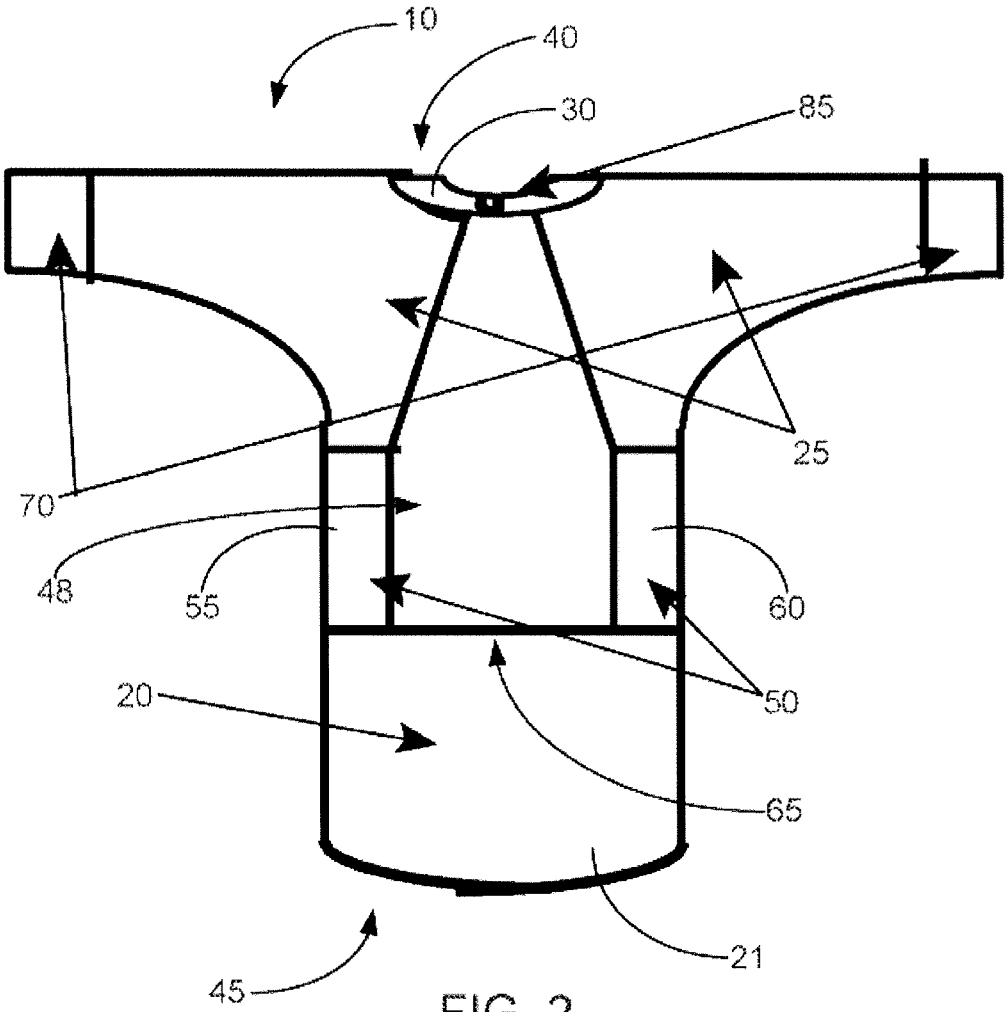
FIG. 2 illustrates a back side view of a representative embodiment of the body cover.

While the body cover can comprise any suitable component that allows it to be placed on a user who is already sitting down (and/or in any other suitable position), FIGS. 1 and 2 show that, in some embodiments, the body cover 10 comprises one or more body portions (or main bodies) 15, foot pouches 20, arms 25 (e.g., a first 26 and second 27 arm), collars 30, pockets 35, and/or other suitable components.

Figure 6A:
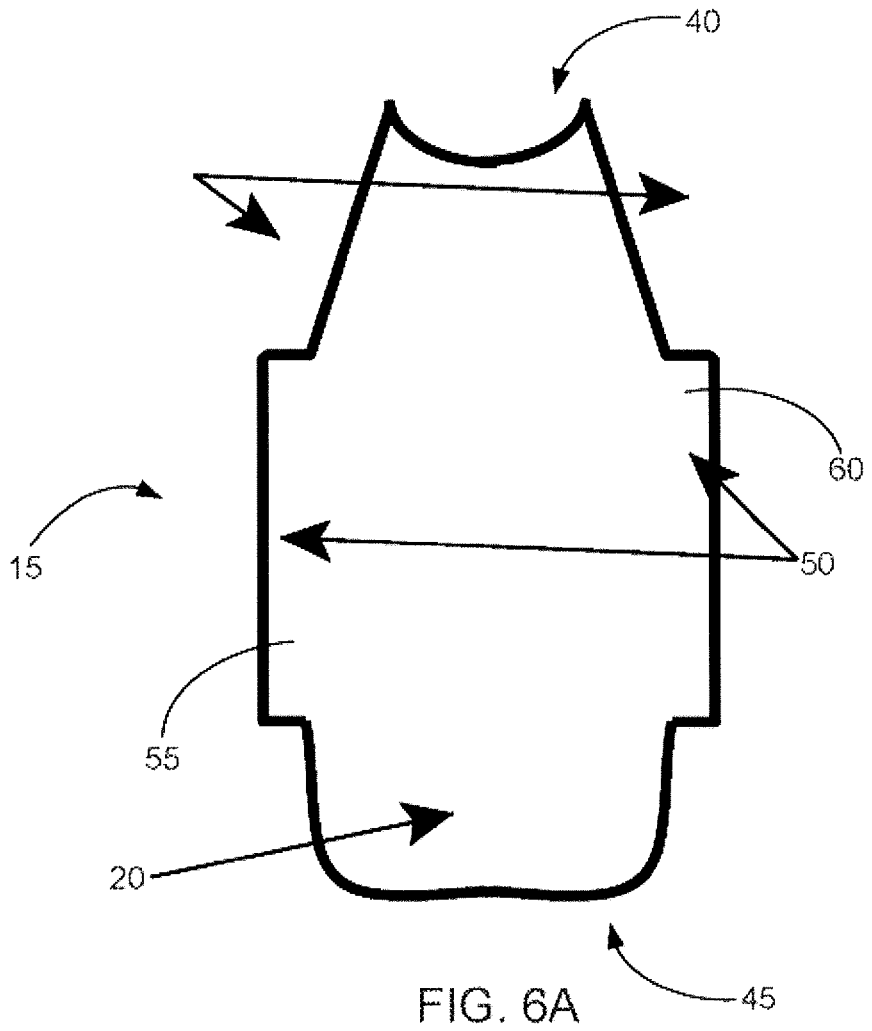
Figure 6B:
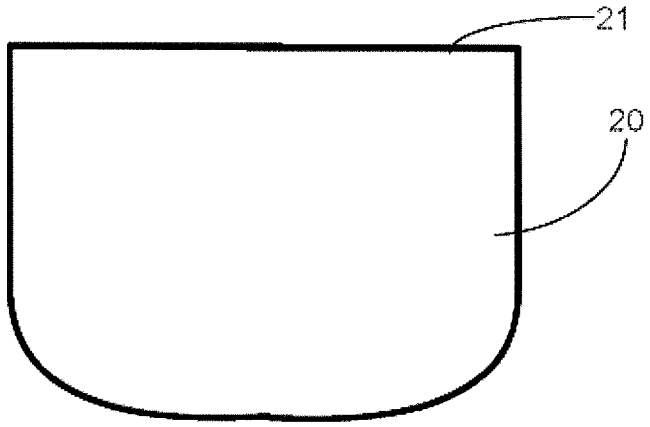

With reference to the body portion 15 or main body, the body portion can comprise any suitable characteristic that allows it to cover at least a portion of its wearer's torso, waist, legs, and/or feet. Indeed, in some embodiments, the main body is configured to extend down a front portion of its wearer, from the wearer's neck and down over the wearer's feet. Thus, in some embodiments (as illustrated in FIGS. 1-2 and 6A), the body portion 15 comprises one or more pieces of material extending from a neck end 40 (or proximal end or portion) to a foot end 45 (or distal end or portion) of the body cover.

Figure 4A:
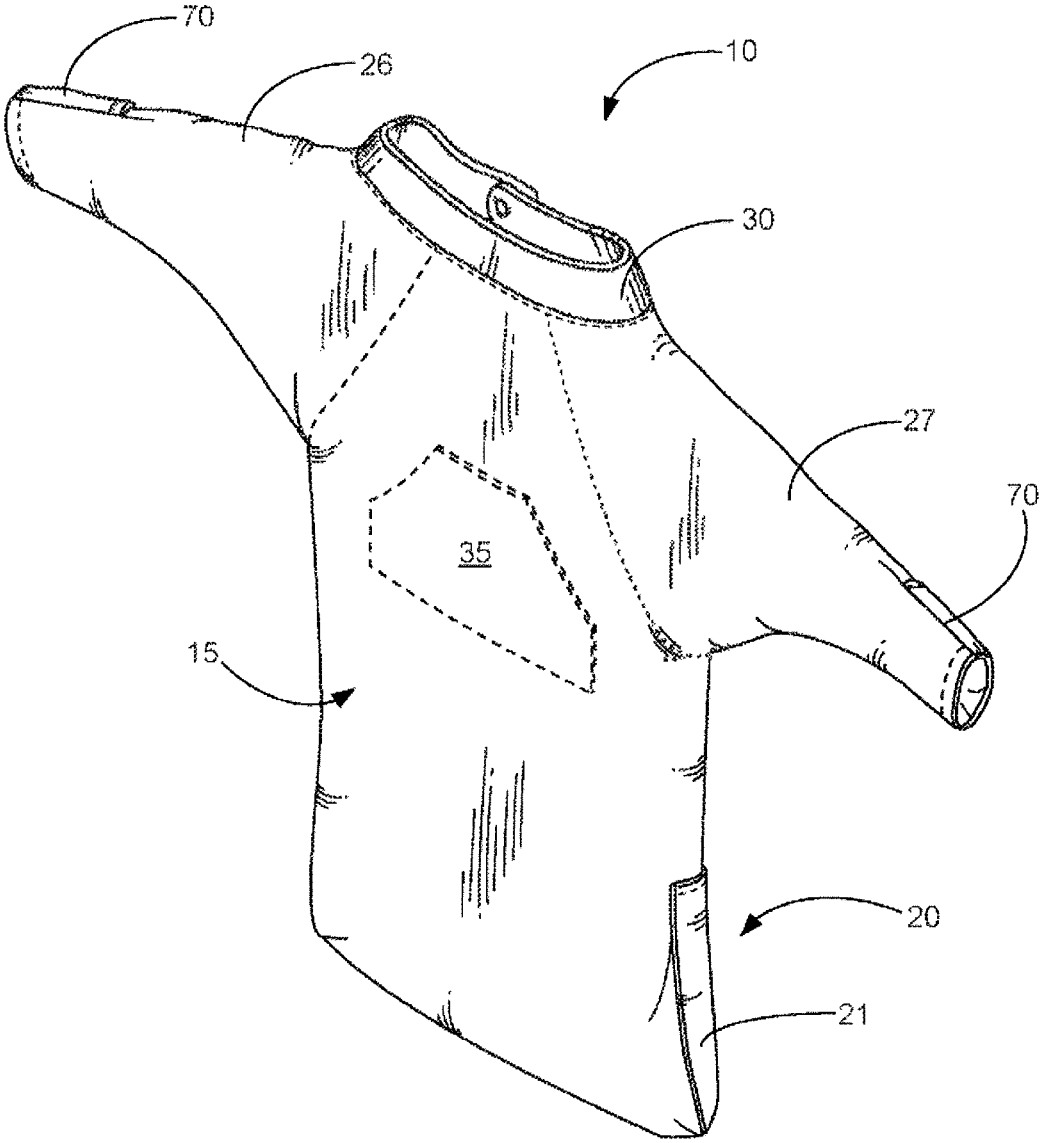
FIG. 4A illustrates a perspective view of a representative embodiment of the body covering.
Figure 4B:
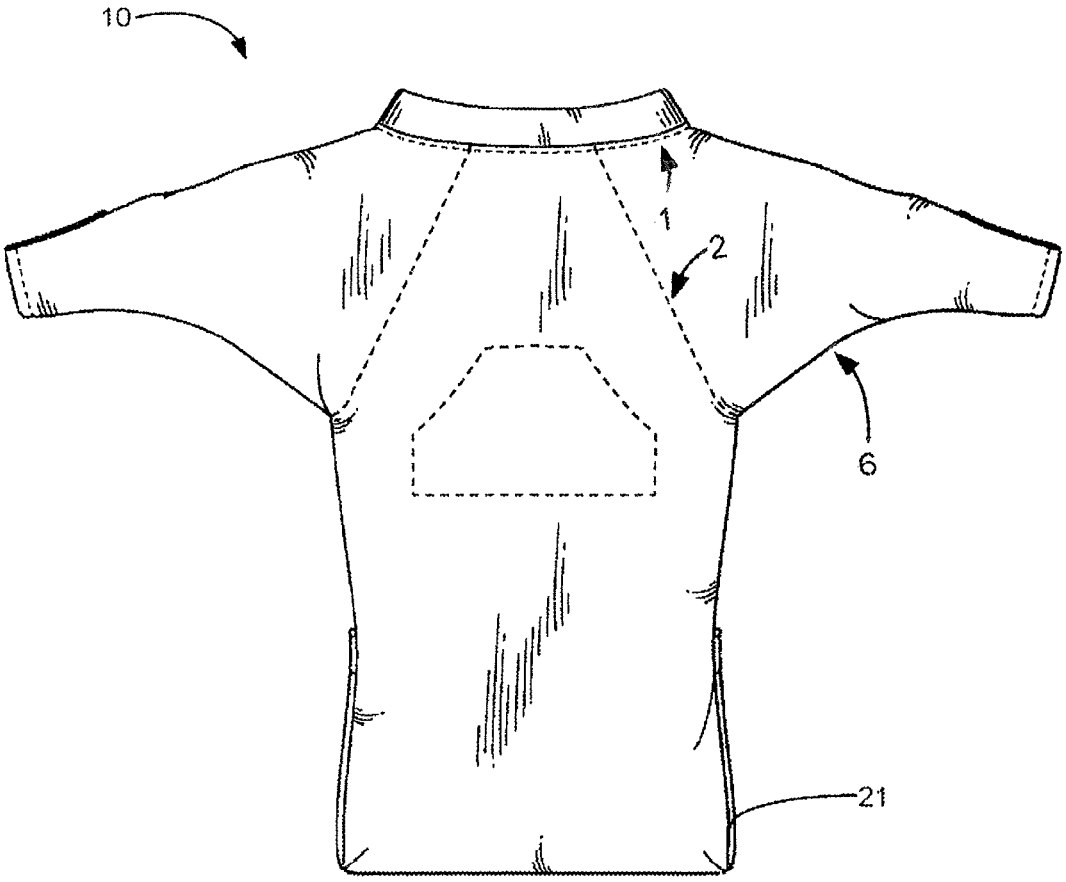
FIG. 4B illustrates a front elevation view of a representative embodiment of the body cover.
Figure 4C:
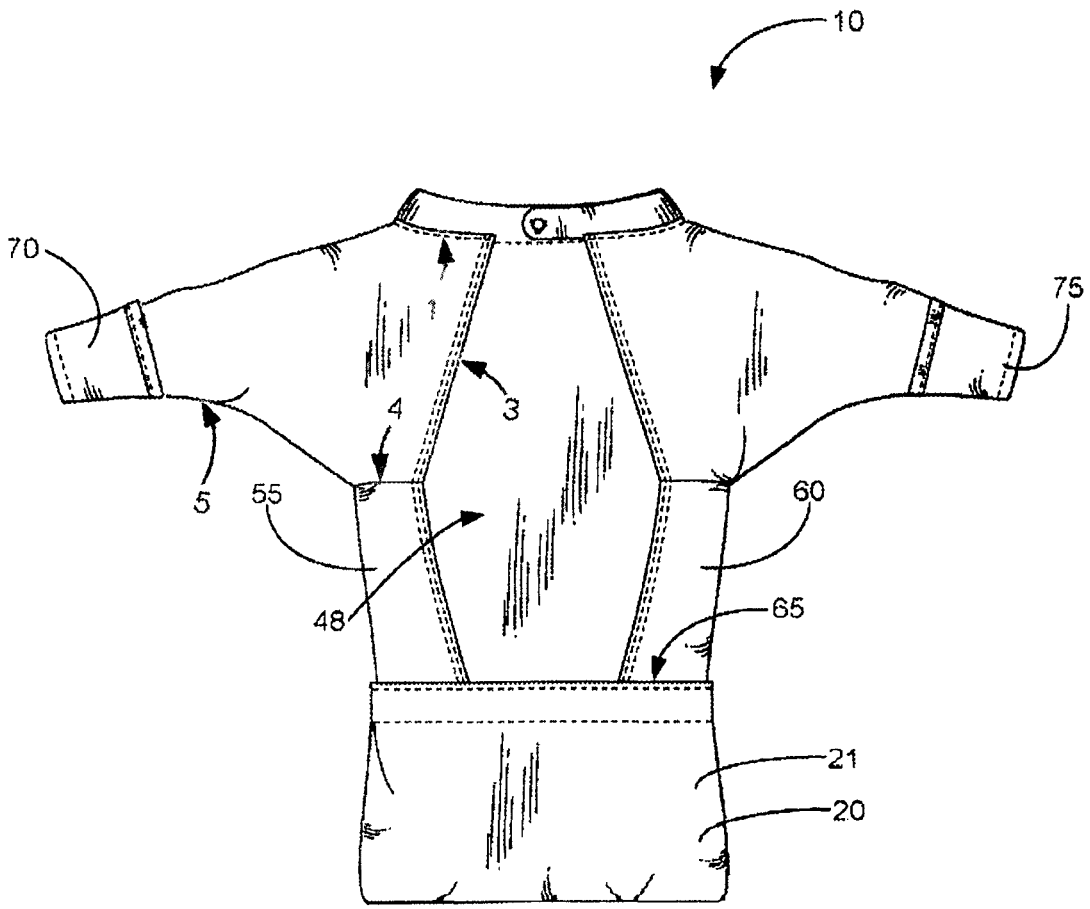
FIG. 4C illustrates a back elevation view of a representative embodiment of the body cover.
Figure 4D:
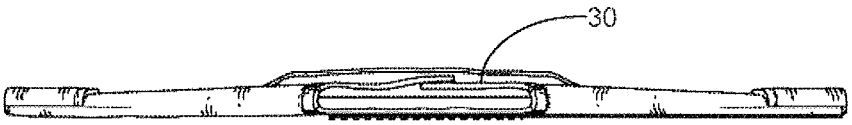
FIG. 4D illustrates top plan view of a representative embodiment of the body cover.
Figure 4E:
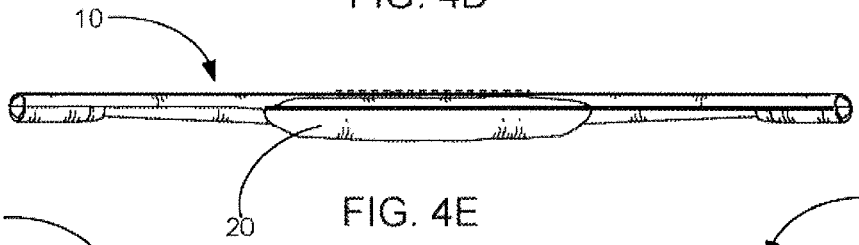
FIG. 4E illustrates a bottom plan view of a representative embodiment of the body cover.
Figure 4F:
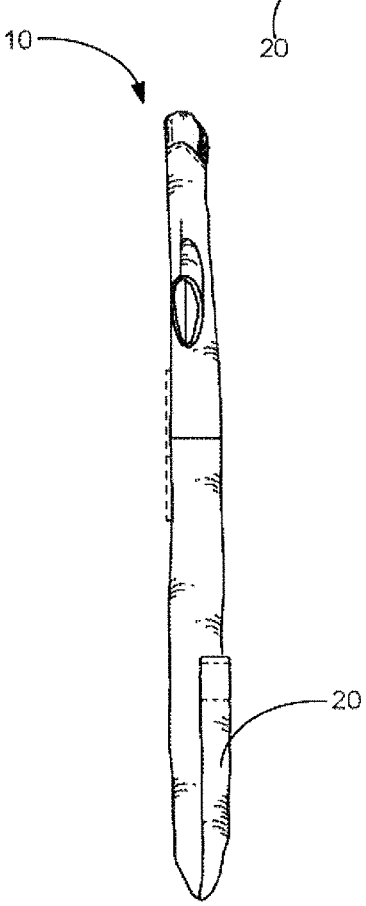
FIG. 4F illustrates a right side elevation view of a representative embodiment of the body cover.
Figure 4G:
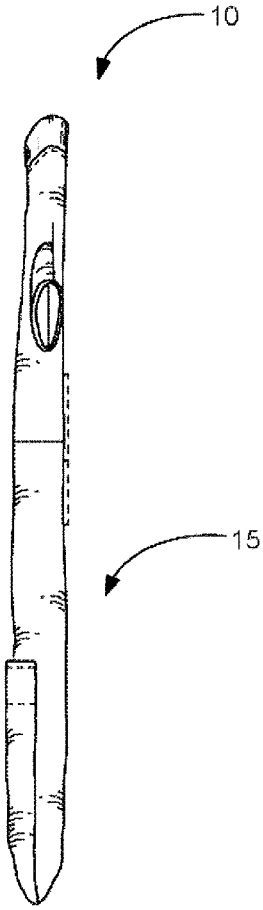
FIG. 4G illustrates a left side elevation view of a representative embodiment of the body cover.
Figure 5A:
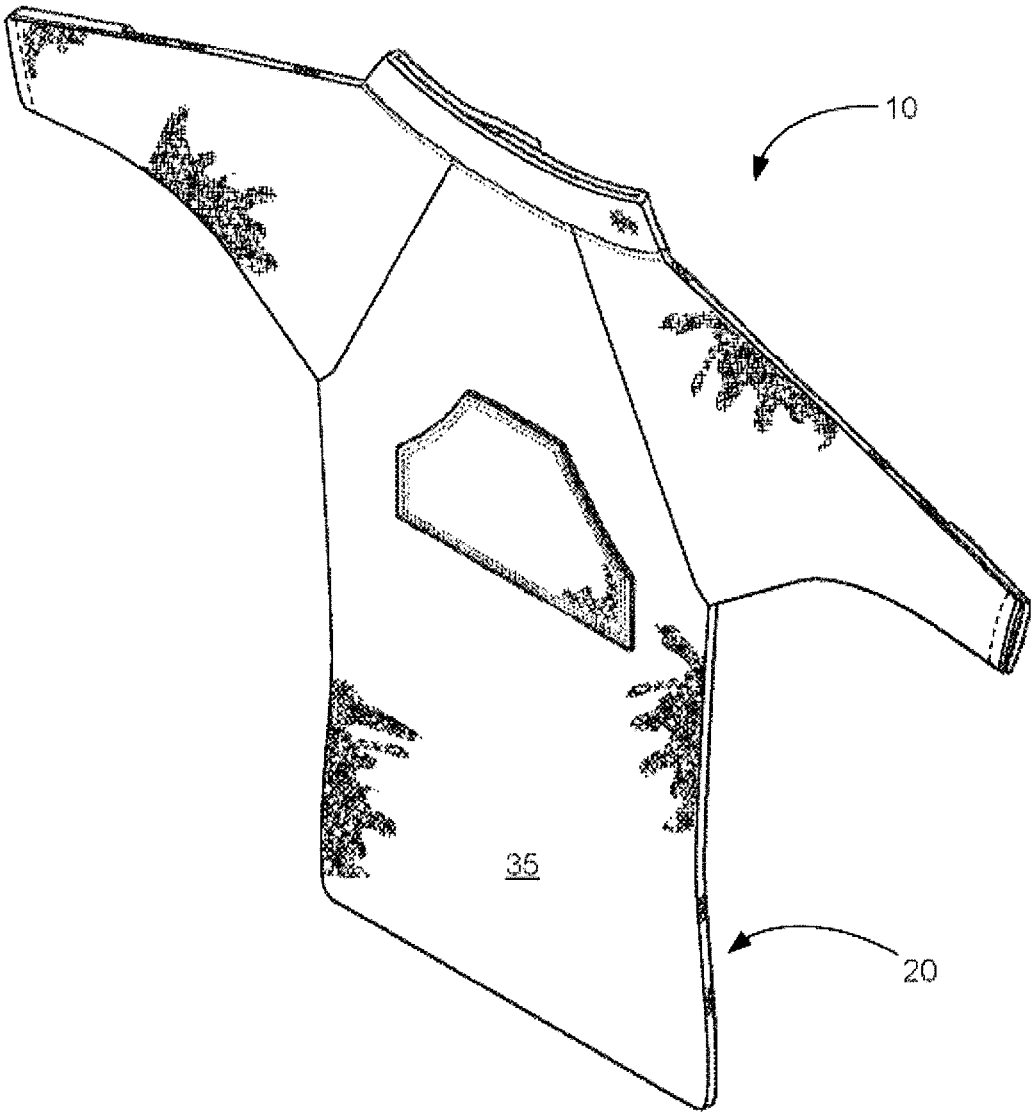
FIG. 5A illustrates a perspective view of a representative embodiment of the body cover.
Figure 5B:
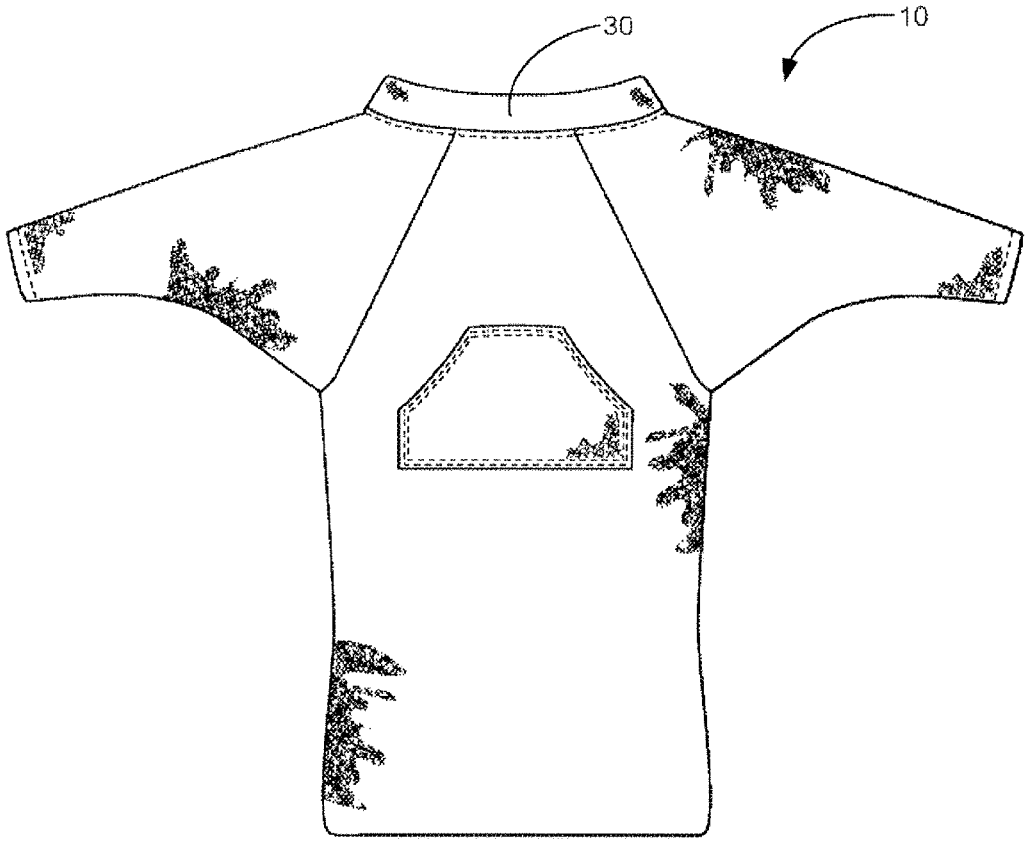
FIG. 5B illustrates a front elevation view of a representative embodiment of the body cover.
Figure 5C:
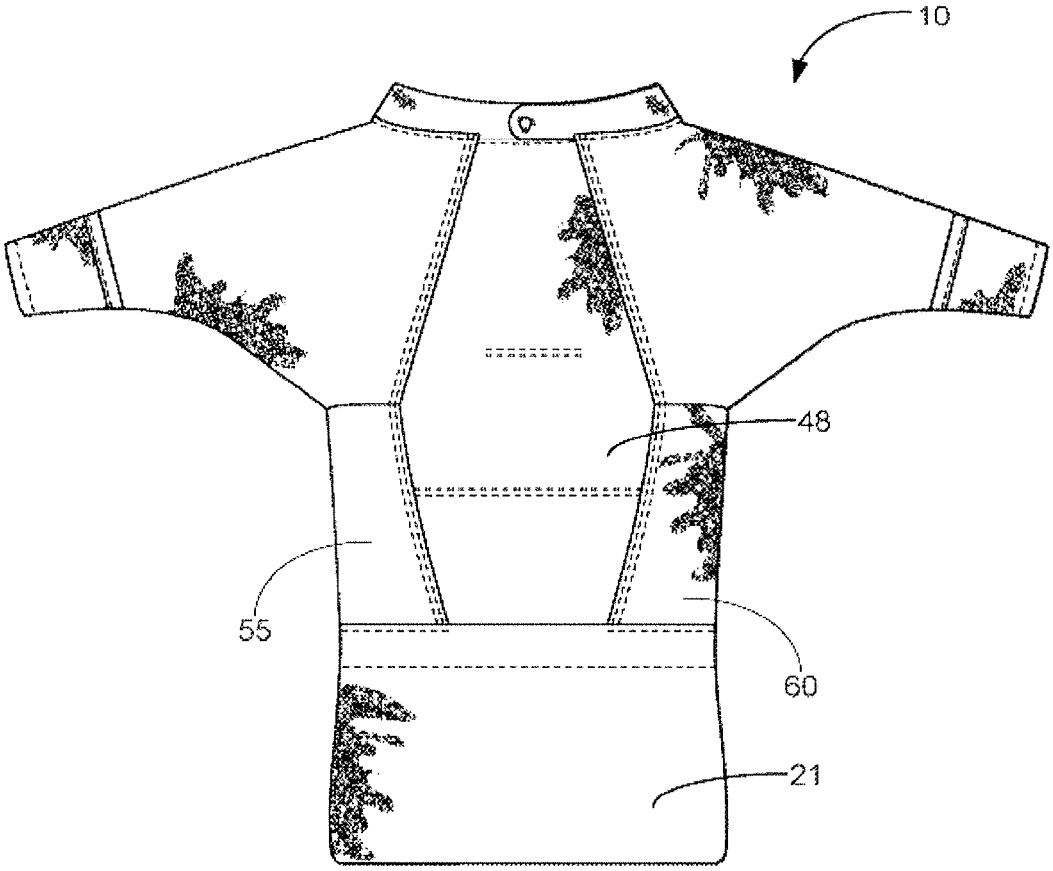
FIG. 5C illustrates a back elevation view of a representative embodiment of the body cover.
Figure 5D:
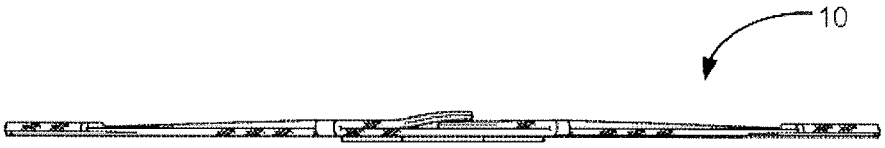
FIG. 5D illustrates top plan view of a representative embodiment of the body cover.
Figure 5E:
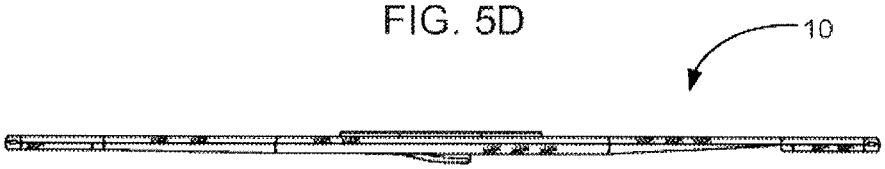
FIG. 5E illustrates a bottom plan view of a representative embodiment of the body cover.
Figure 5F:
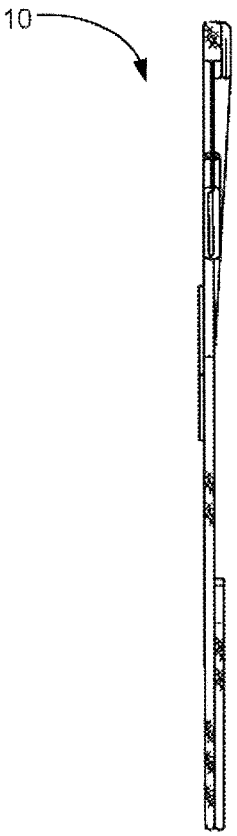
FIG. 5F illustrates a right side elevation view of a representative embodiment of the body cover.
Figure 5G:
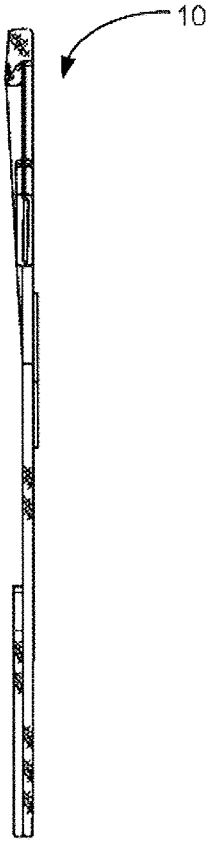
FIG. 5G illustrates a left side elevation view of a representative embodiment of the body cover.

While the body portion 15 is configured to cover at least a portion of a front side (or chest side) of its wearer, in some embodiments, the body portion (and/or another suitable portion of the body cover 10) is configured to extend over a portion of its wearer's lateral side (e.g., over a portion of the wearer's side, below the wearer's arm), over a lateral portion of its wearer's back, and/or over (or up to) a portion of its wearer's spine. In some embodiments, however, the body portion and the body cover are configured such that when a baby, toddler, child, adult, and/or other person wears the body cover, at least a portion of that person's back is not covered by the body cover. In such embodiments, the body cover comprises a back opening (see e.g., opening 48 in FIG. 2) that is configured to limit the amount of material that (and/or to ensure that no amount of material) is sandwiched between the wearer and an object against which the wearer's back is placed (e.g., a car seat, a back of a wheel chair, chest of a person carrying the user in a baby harness, and/or any other suitable object). Accordingly, by having the opening reduce the amount of material at a back of the body cover, some embodiments of the body cover do not significantly (if at all) affect the tightening of car seat straps and/or any other straps around the wearer of the body cover. Thus, some embodiments of the body cover are safer for use with car seats than are some conventional car seat covers.

Where the body portion 15 (and/or the body cover 10) is configured to extend around and cover at least a portion of its wearer's lateral sides and/or lateral portions of its wearer's back, the body portion (and/or body cover) can be configured in any suitable manner that allows the body cover to perform such a function. In some embodiments, however, the body portion 15 (and/or the body cover) comprises one or more lateral flaps that are configured to extend from a front portion (or surface) of the body portion to a lateral side and/or a lateral back portion of the person wearing the body cover. By way of non-limiting illustration, FIGS. 2, 4C, 5C, and 6A show some embodiments in which the body portion 15 comprises one or more lateral flaps 50 (e.g., a first lateral flap 55 and a second lateral flap 60).

Where the body portion 15 (and/or body cover 10) comprises one or more lateral flaps 50, the lateral flaps can have any suitable characteristic that allows the body cover to function as described herein. Indeed, in some embodiments of the flaps comprise one or more mechanisms for coupling the flaps together with each other (e.g., via one or more snaps, buttons, zippers, ties, magnets, frictional couplers, magnetic couplers, and/or other suitable coupling mechanisms). In other embodiments, however, the first 55 and second 60 lateral flaps do not include any coupling mechanisms that are configured to couple the flaps to each other (e.g., to close the opening between the flaps) when the flaps are moved to their medial-most position (e.g., as far medially towards the wearer's spinal cord as is comfortably possible, and as shown in FIGS. 2, 4C, and 5C). Accordingly, in some embodiments, there are no uncomfortable coupling mechanisms on the lateral flaps to press against the wearer's back. Moreover, in some embodiments, the back side of the body cover is configured to always be at least partially opened when worn (e.g., to allow for straps, for safety purposes, etc.).

Where the back side of the body cover 10 comprises an opening 48, the opening can be any suitable size that allows the body cover to function as described herein. Indeed, in some embodiments, when a person wears the body cover, the opening between the first 55 and second 60 flaps can have any suitable width. Indeed, in some embodiments, when the wearer is wearing the body cover and the lateral flaps are moved to their most medial position (as is reasonably comfortable and desirable for the wearer), the space between the medial-most portions of the lateral flaps is between about 0.1 cm and about 18 inches (or any subrange thereof). Indeed, in some embodiments, the width of the opening is between about 1 and about 8 inches when the body cover is worn by wearer of intended size.

Where the body cover 10 comprises one or more lateral flaps 50, the lateral flaps can couple with any other suitable portion of the body cover, including, without limitation, to the body portion 15, the foot pouch 20, the arms 25, and/or any other suitable portion of the body cover. By way of non-limiting illustration, FIGS. 2, 4C, and 5C show some embodiments in which a distal end (or an end that is closer to the foot end 45 of the cover 10) of the first 55 and second 60 lateral flaps is coupled to a proximal portion 65 of the foot pouch 20. Additionally, FIGS. 2, 4C, and 5C show some embodiments in which a proximal end (or an end that is closer to the neck end 40 of the cover) of the first 55 and second 60 lateral flaps is coupled to a portion of a corresponding arm 25 (e.g., a distal, back portion and/or any other suitable portion) of the arms. In this regard, the lateral flaps can be coupled to the other portions of the body cover in any suitable manner, including, without limitation, by being sewn to, knitted with, formed with, melted together with, and/or otherwise being connected with the other portions of the body cover. In any case, by having the lateral flaps couple to the foot pouch and/or the arms, some embodiments of the body cover are configured to ensure that an opening 48 of a desired size is defined between the first and second flaps, the first 26 and second 27 arms, a proximal end 65, the collar 30, and/or a perimeter of any of the foregoing.

With reference now to the foot pouch 20, some embodiments of the body cover 10 comprise a foot pouch at the cover's foot end 45. While the foot pouch can perform any suitable function, in some embodiments, it: helps to keep the wearer's feet and/or legs warm, to keep the wearer's feet and/or legs clean (e.g., when the body cover functions as a bib), to cover the wearer's feet such that the wearer cannot easily kick off the foot pouch, and/or it performs any other suitable function. Indeed, in some embodiments, the foot pouch acts like a giant sock that is configured to keep its wearer's feet warm.

Where the body cover 10 comprises a foot pouch 20, the foot pouch can be formed in any suitable manner, including, without limitation, by being integrally formed with the body portion 15 and/or by being coupled to the body portion. By way of non-limiting illustration, FIGS. 2, 4A-4C, 4E-4G, 5C, 5F, 5G, and 6B show some embodiments in which the foot pouch 20 is formed with a piece of material 21 that is coupled to the body portion 15.

With respect to the arms 25, the body cover 10 optionally includes a first 26 and a second 27 arm. In this regard, the arms can perform any suitable function, including, without limitation, keeping the wearer's arms warm, keeping the wearer's arms dry and/or clean, helping to anchor the body cover to the wearer, and/or to perform any other suitable function. Additionally, the arms can cover any suitable portion of the wearer's body, including, but not limited to, at least a portion of the wearer's: arms, chest, shoulders, back, and/or other suitable body part. Indeed, in some embodiments in which the arms are coupled directly into the body portion (e.g., extending from holes formed in the body portion), the arms are configured to cover at least a portion of the wearer's arms. In some other embodiments (as shown in FIGS. 1-5G and 6C-6D), the arms 25 are configured to cover a portion of the wearer's arms, shoulders, chest, and/or back.

Where the body cover 10 comprises arms 25, the arms can be disposed in any suitable location on the body cover (i.e., protruding from a front and/or side surface of the body portion 15). In accordance with some embodiments, however, FIGS. 1, 3, and 4A-4C show that the arms 25 extend from a lateral portion or perimeter of the body portion. In this regard, while the arms can extend from the body portion at any suitable angle, FIGS. 1, 3, and 4A-4C show some embodiments in which the arms 25 are coupled to the body portion at an angle.

Figure 6C:
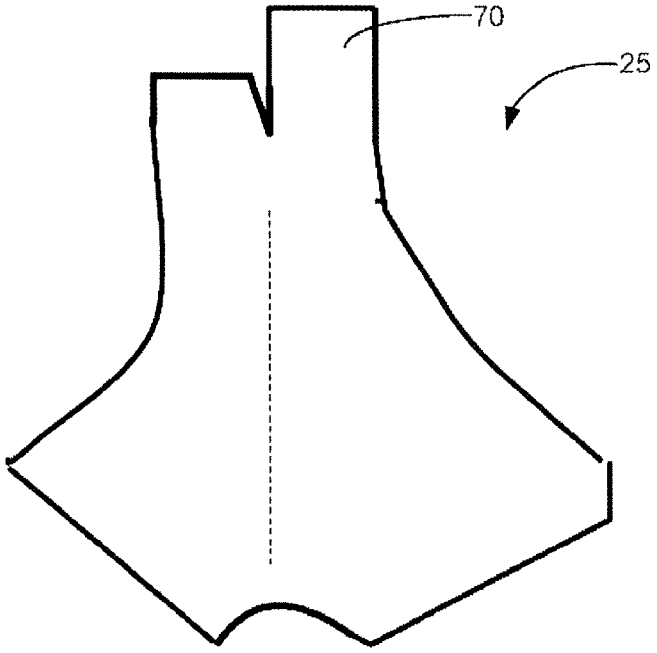
Figure 6D:
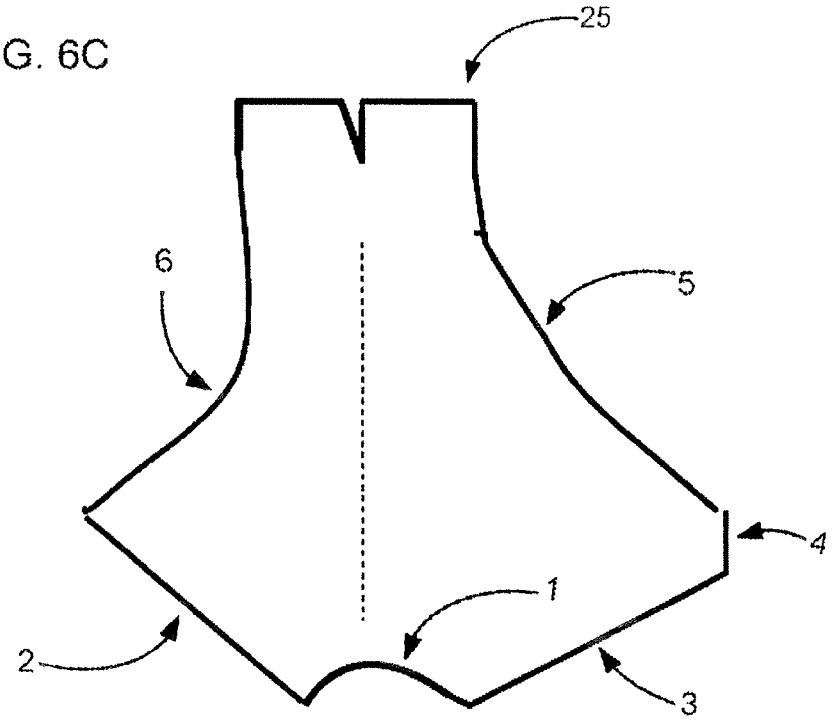
Figure 6E:
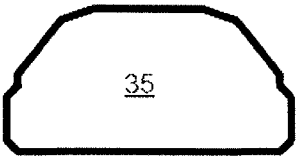

While the arms 25 can have any suitable characteristic, FIGS. 6C-6D show some embodiments of suitable arm patterns. Specifically, FIGS. 6C-6D show that in some embodiments the arms comprise wrap around sleeves that are designed and cut to wrap around the back of the wearer's body to keep the body cover in place and to keep the wearer warm. Additionally, such drawings show that, in accordance with some embodiments, the arms are formed to fit the wearer as closely and smoothly as possible, to avoid bulkiness and excess fabric under the wearer's body. Such drawings further show that, in some embodiments, the arms 25 are designed to be folded down their center (e.g., along the vertical dotted line in the drawings). Once the arms are folded down their center line, the corresponding edges can be coupled together and/or coupled to the body portion 15 (e.g., via sewing and/or in any other suitable manner). FIG. 6D illustrates a first end 1, a second end 2, a third end 3, a fourth end 4, a fifth end 5, and a sixth end 6.

While the arms 25 can have any suitable feature, in some embodiments, the ends of the arms optionally comprise and/or are otherwise configured to be used with one or more hand coverings, including without limitation, one or more wrap-around hand covers, mittens, gloves, fingerless gloves, convertible fingerless gloves with mitten covers, hand socks, sleeves with thumb slots, and/or other suitable hand covers. In some embodiments, however, one side of the sleeve (or arm portion) is longer than the other, providing extra fabric that can be folded down and stitched in a manner such that when the sleeve is seamed together, the extra piece of fabric that can be wrapped around the hand to act as a pocket-like mitten (or a wrap-around hand cover 70). In this regard, the extra fabric goes on the back of the sleeve, and when it is not in use, both sides of the sleeve appear to be the same length. As another example of a suitable component, some embodiments of the arms comprise one or more elastic and/or elastomeric bands 75 at the arms' ends.

Turning now to the collar 30, some embodiments of the body cover 10 optionally comprise a collar that is configured to extend around the wearer's neck. In this regard, the collar can comprise any suitable feature. For instance, in some embodiments, the collar is configured to pull a proximal end of both of the arms into proximity with each other (and/or so as to overlap each other). In other embodiments, a portion of the collar (e.g., as illustrated in FIG. 4C) extends between about 0.1 inch and about 10 inches (or any subrange thereof) medially past the medial-most portion of a backside of the arms 25. Accordingly, in some embodiments, the collar can help keep the body cover on the wearer, while being comfortable around the wearer's neck. In this regard, the collar can be any suitable width, including, without limitation, being wider (or broader) than, substantially equal to, and/or smaller (or narrower) than a width of the foot pouch 20. Indeed, in some embodiments, the collar has a width that is substantially equal, from a left side of the collar to a right side of the collar, to a width of the foot pouch.

Figure 6F:
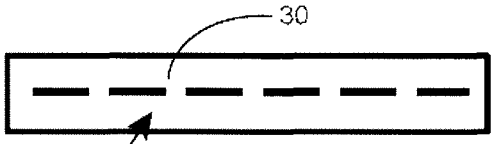
Figure 6G:
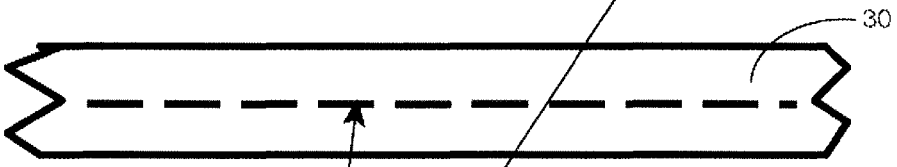
Figure 6H:
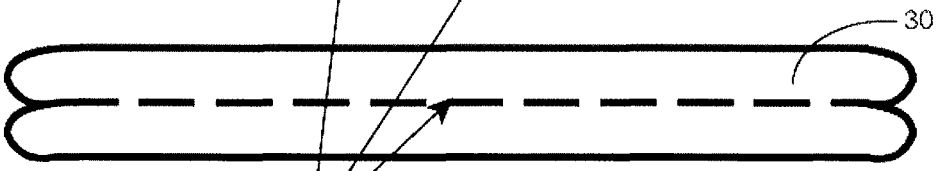

Additionally, while the collar can have any suitable design, FIGS. 6F-6H show some examples of patterns for collars 30 that are configured to be folded in half (e.g., along the broken lines 80), with one collar being configured to have square ends (e.g., FIG. 6F), another collar having pointed ends (e.g., FIG. 6G), and another collar having rounded ends (e.g., FIG. 6H).

In accordance with some embodiments, some embodiments of the collar 30 optionally comprise one more closing mechanisms that are configured to selectively close and/or open the collar. In this regard, the collar can comprise any suitable closing mechanism, including, without limitation, one or more snaps, buttons, hook and loop fasteners, hooks and eyelets, ties, magnets, couplers, coupling mechanisms, frictional couplers, mechanical couplers, and/or other suitable mechanisms that are configured to selectively couple and decouple to ends of the collar 10. Indeed, in some embodiments (as shown in FIG. 2), the collar comprises one or more snaps that allow the collar to be selectively closed and/or opened and/or adjusted in diameter. That said, even in some embodiments that have a closing mechanism, use of the closing mechanism can be optional.

Figure 3:
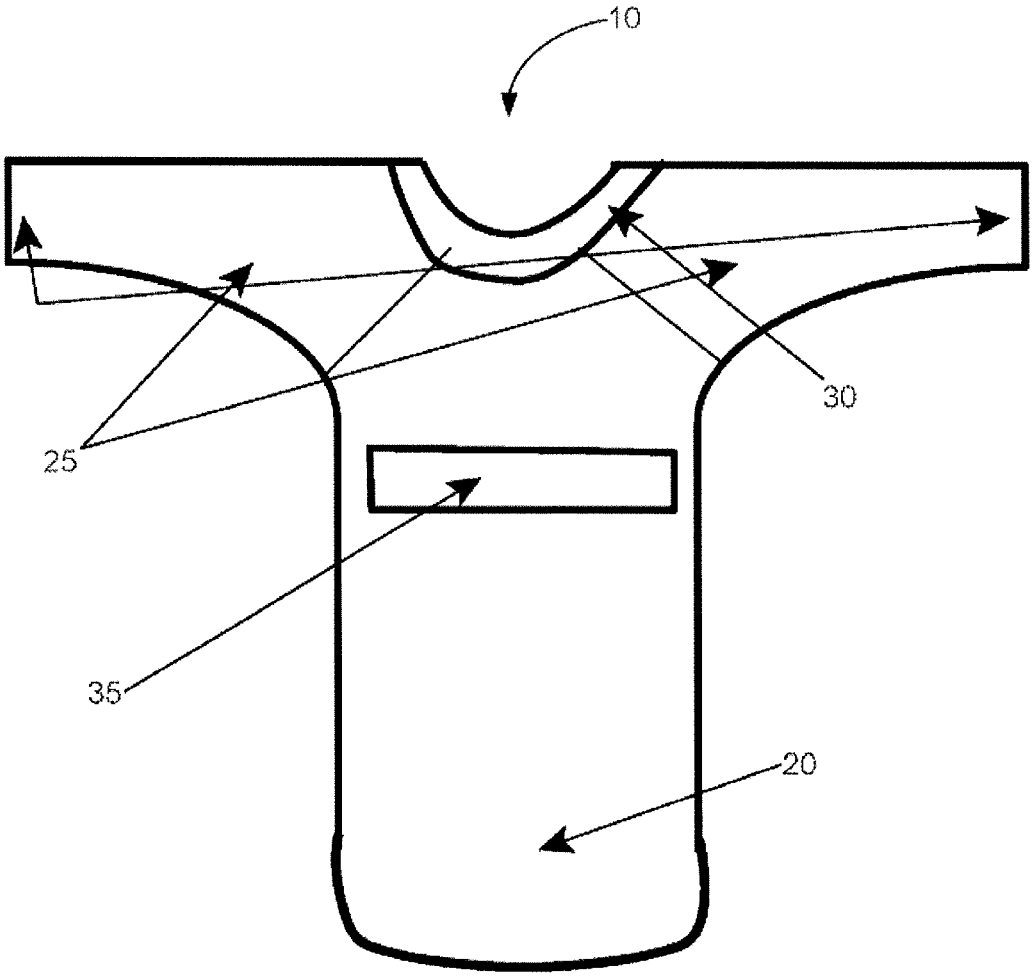
FIG. 3 illustrates a front side elevation view of a representative embodiment of the body cover comprising a crumb catching pocket.

Turning now to the pocket 35, some embodiments of the body cover 10 comprise one or more pockets. In this regard, the pockets can be disposed in any suitable location, including, without limitation, on a front, side, back, top, bottom, and/or any other suitable portion of the body cover. By way of non-limiting illustration, FIGS. 1 and 3 show some embodiments in which the body cover 10 comprises one or more pockets 35 on a front side of the body cover 10.

Where the body cover 10 comprises one or more pockets, the pockets can have any suitable characteristic. Indeed, the pockets can have any suitable type and number of openings. By way of non-limiting illustration, FIG. 1 shows an embodiment in which the pocket 35 comprises two openings at upper and outer corners of the pocket so as to allow the pockets to be easily accessible to the wearer (e.g., for binkies, food, and/or other suitable objects). In another illustration, FIG. 3 shows an embodiment in which the pocket 35 comprises a crumb catching pocket that defines an opening at is proximal-most end such that the pocket is configured to catch items that fall above it (e.g., when the body cover comprises a bib).

In addition to the described systems, methods, characteristics, and embodiments, the body cover 10 can be varied in any suitable manner. For example, some embodiments of the body cover comprise a hood, a hood sling, a foot pouch 20 that is configured to be separated into two legs (e.g., via one or more zippers, snaps, hook and loop fasteners, and/or other suitable mechanisms), openable foot pouch, vents (e.g., in the arm pits and/or any other suitable location), insulating seats (e.g., for sitting on bleachers), openings (e.g., to access car seat strap tightener), and/or any other suitable component.

The described body cover 10 can be produced in any suitable manner, including, without limitation, via one or more methods that involve cutting, stamping, knitting, and/or otherwise forming one or more components of the covering (e.g., the body portion 15, arms 25, collar 30, foot pouch 20, and/or any other suitable portion of the body cover). In some embodiments, the various portions of the body cover are then coupled together in any suitable manner, including, without limitation, by stitching, melting, gluing, snapping, coupling via one or more fasteners (e.g., snaps, buttons, zippers, hook and loop fasteners, hooks and catches, and/or any other suitable fasteners), and/or otherwise coupling the various portions of the body cover together in any suitable manner. Indeed, in some embodiments, the various portions of the body cover 10 are cut out (e.g., as shown in FIGS. 6A-6H) and sewn together to form the body cover.

The described body cover 10 and its various components can comprise any suitable materials that allow it to function as described herein. In some embodiments, it comprises one or more fabrics, plush fabrics, cloths, terry cloths, felts, plush felts, velboa plush fabrics, long hair plush fabrics, flannel, velvets, furs, leathers, microfibers, polyester, rayon, cotton, wool, polycotton, linen, silk, canvas, layers or combinations of fabric and linings (as used in traditional coats), water-resistant fabrics, wind-resistant fabrics, Sherpa, velour, minky fabric nylon, finely woven materials, plastic coated materials, polymer coated materials, polymer impregnated materials, fluoropolymers, faux fur, plush furs, plastics, polymers, batting, stuffing, foam, memory foam, insulation, polytetrafluoroethylene (PTFE), water-resistant materials, stain-resistant materials, and/or any other suitable material. Indeed, in some embodiments, the body cover comprises a fleece and/or another material that is configured to keep its wearer warm. In some other embodiments, however, at least a front surface of the body cover comprises a polymer (e.g., a polymer sheet) such that the body cover is configured to be easily cleaned. Indeed, in some embodiments, as shown in FIG. 3, the body cover 10 comprises a bib (e.g., for use in a highchair, car seat, and/or any other suitable location).

Some embodiments of the described body cover 10 are different from other competing products in one or more ways. Indeed, there are many car seat covers available on the market today. That said, many of them have fabric or a bulkiness that is required to come between the straps of the car seat and the child's body. Additionally, some competing devices are full-body, zip-up suits or blankets that go both under and on top of the baby and that, in some cases, zip up on the sides. However, some of these conventional devices can potentially cause serious problems, especially if they compress during an accident and make the car seat straps too loose to properly restrain the baby during the accident.

In contrast, some embodiments of the described body cover do not come between the child and the car seat straps at all. Accordingly, the child is placed in the car seat with the straps adjusted correctly from the beginning. In some embodiments, the body cover goes over the top of the child, without making any changes to the tightness of the straps. Thus, in an accident, there will be nothing (in such embodiments) to come between the child and the safely-secured straps of the car seat.

In some other conventional car seat covering options, a car seat covering is configured to go over the entire car seat itself and usually attach themselves around the seat with an elastic. While this version of car seat cover is helpful because it does not put any fabric or bulkiness between the child and the car seat straps, some such devices have drawbacks. For example, in some cases, the hole for the child's head in the car seat covering is in one location. As a result, if the child is too tall or too small and not the exact height for which the car seat cover was designed, the child's face may not be positioned where the hole is for the head. This could lead to covering the child's face. This can also be problematic because it only fits the child as long as his or her body is smaller than the car seat edges. Thus, as soon as the child grows large enough that the child's head extends near the top of the seat or the child's legs reach past the bottom of the seat, the child may no longer be able to fit under the car seat cover without it squishing their legs or head. This means that some such car seat covers cannot properly be used with an older baby or toddler, whose head or legs extend beyond the edges of the car seat.

In contrast with such car seat covers, some embodiments of the described body cover are configured to allow a child (or other wearer) to have free movement of their arms and hands. Additionally, some embodiments are configured to ensure that no part of the body cover covers the child's face, regardless of how the child grows and changes. Moreover, some embodiments of the body cover are sized, shaped, and otherwise configured to ensure that they do not restrict head or leg movement when the child grows to be longer than the car seat itself. In this regard, even if the child outgrows his or her body cover, the described body cover comes in many sizes, so a new one can easily be purchased and can fit with any size of car seat.

Some further types of conventional car seat covers that are available today include those that cover the entire car seat, using the handle of the car seat as a frame for the cover. In this regard, some of them are configured to drape over the child with straps that come off of the handle. Again, however, many such devices are configured to cover the child in the car seat as long the child is smaller than the car seat. Accordingly, as a child grows beyond the size of the car seat, the child outgrows such conventional covers. Indeed, once a child outgrows such a covering, it will hang directly on the child's head, and the child's feet and legs will also likely hang out the bottom of such a covering. Additionally, some such conventional coverings are designed to leave space between the covering and the child. As a result, such coverings can be drafty—especially if the wind is blowing.

Another form of conventional car seat cover that uses the car seat's handle as a frame is one made of very stretchy fabric that cradles all around the baby to keep the baby warm. Again, some embodiments of this option can be become problematic in a relatively short time because they cannot properly be used when the baby grows bigger than the edges of the car seat—even through the baby technically has not outgrown the car seat. Thus, some conventional car seat covers cannot properly be used once the child no longer uses a car seat that has a carrying handle because the handle itself serves as the backbone for some such covers.

On the other hand, some embodiments of the described body cover 10 do not rely on the handle at all. As a result, some such embodiments can be used with any kind of car seat. Moreover, some such embodiments continue to be usable after the baby has outgrown the basic edges of the car seat. Again (and as previously stated), a child may outgrow the body cover, but larger sizes are available and will continue to work for the child as long as the child is in a car seat (no matter how much of the child overhangs the edges of the car seat). Some other competing devices comprise a blanket with sleeves. In some cases, such devices are configured to be "one-size-fits-all" products, which are designed to fit loosely, with lots of excess fabric.

In contrast, some embodiments of the described body cover 10 have uniquely designed sleeves that are configured to wrap around the shoulders and back of the child (or other wearer). In some such embodiments, such a design is configured to minimize excess fabric for the safety and comfort of the wearer. Additionally, unlike the loosely-draped sleeves of some conventional devices, some embodiments of the sleeves of the described body cover are tapered at the bottom to keep them relatively tight around the child's (or other wearer's) wrists.

Additionally, some embodiments of the body cover have wrap-around hand covers 70—something that is lacking on many competing devices. Moreover, some embodiments of the described body cover are also sized and shaped to fit many different sizes of children, almost as closely as the sizing of coats and jackets, unlike the "one-size-fits-all" approach of some competing devices. Indeed, some embodiments of the described body cover are configured to "hug" or fit snugly around the shape of the body of the child, unlike the loose, flowing, rectangular shape of some competing devices. Additionally, unlike some conventional devices, some embodiments of the body cover comprise a foot pouch 20 that that is configured to envelop a portion of a wearer's feet.

As still an additional feature of the described body cover 10, some embodiments of the body cover are configured to leave an opening 48 at a portion of a user's back when the user wears the cover. Accordingly, in some such embodiments, the body cover can readily be placed on and/or removed from a person who is strapped in a car seat, strapped in a baby harness, sitting in a wheelchair, sitting in a chair, lying in a bed, and/or in any other suitable location. Additionally, in some such embodiments, by having an opening that is not configured to be closed (e.g., by not having coupling mechanisms to couple the first 55 and second 60 lateral flaps together; by having the first 55 and second 60 lateral flaps be configured to not contact each other when the body cover is worn and the flaps are moved to their medial-most position, or towards the wearer's spine; and/or by not otherwise being configured to be closed), the body cover is able to keep its wearer warm (or otherwise covered) while keeping the wearer comfortable (e.g., by not having excess material, snaps, ties, zippers, and/or other closing mechanisms between the wearer and the car seat or other object). Moreover, by not having excess material between the wearer and the car seat, some embodiments of the body cover are configured to not prevent a child from being properly and safely buckled in a car seat.

Thus, as discussed herein, the embodiments of the present invention embrace apparel, clothing, and/or other body coverings. In particular, some embodiments of the described systems and methods provide a body cover that is configured to cover a user's arms, legs, feet, and/or front side. In some cases, the covering's backside is configured to remain at least partially open such that the covering can easily be placed over a person in a car seat, a wheel chair, and/or any in any other suitable location.

The present invention may be embodied in other specific forms without departing from its spirit or essential characteristics. The described embodiments and examples are all to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A body cover comprising:

a body portion wherein at least a portion of the body portion is configured to cover:

a front portion of a user's legs, waist, and torso;

a first lateral portion and a second lateral portion of the user's torso; and a back portion of the user's legs when the user wears the body cover;

a first sleeve that is coupled to and extends from a first lateral side of the body portion, wherein the first sleeve comprises at least six ends, the first end interposed between the second and third ends, wherein the second and fourth ends are coupled to a portion of the body portion, and wherein the fifth end is coupled to the sixth end; and a second sleeve that is coupled to and extends from a second lateral side of the body portion, wherein the body portion, the third end of the first sleeve, and a portion of the second sleeve define an opening that is configured to leave a portion of the user's back exposed when the user wears the body cover.

2. The body cover of claim 1, further comprising a pocket that extends across a front portion of the body portion, wherein a proximal-most portion of the pocket is opened so as to define an opening between the body portion and the proximal-most portion of the pocket.

3. The body cover of claim 1, wherein a front surface of the body portion comprises a polymer sheet.

4. The body cover of claim 1, wherein the body portion comprises:

a first lateral flap that is configured to wrap around and cover a first lateral portion of the user's back when the user wears the body cover; and a second lateral flap that is configured to wrap around and cover a second lateral portion of the user's back when the user wears the body cover, and wherein the opening is defined between the first lateral flap and the second lateral flap.

5. The body cover of claim 4, wherein the first and second lateral flaps do not have any fasteners that are configured to selectively couple the first and second lateral flaps together when the user wears the body cover and the lateral flaps are each moved to a medial-most position.

6. The body cover of claim 4, further comprising a collar disposed at a neck end of the body portion, wherein the first end of the first sleeve is coupled to the collar, wherein the opening is disposed between a perimeter of the first lateral flap, the second lateral flap, the first end of the first sleeve, a portion of the second sleeve, and a portion of the collar.

7. A body cover comprising:

a body portion having a foot pouch, a first lateral flap, and a second lateral flap, wherein the body portion is configured, when the user wears the body cover, to cover:

a front portion of a user's torso, waist, and legs;

a first lateral portion and a second lateral portion of the user's torso; and a back portion of the user's legs;

wherein a proximal end of the foot pouch is coupled to the first and second lateral flaps;

a first sleeve that is coupled to and extends from a first lateral side of the body portion, wherein the first sleeve comprises at least six ends, wherein the first end of the first sleeve is interposed between the second and third ends of the first sleeve, wherein the second and fourth ends of the first sleeve are coupled to the body portion, the fourth end of the first sleeve coupled to the first lateral flap, and wherein the fifth end of the first sleeve is coupled to the sixth end of the first sleeve;

a second sleeve that is coupled to and extends from a second lateral side of the body portion, wherein the second sleeve comprises at least six ends, wherein the first end of the second sleeve is interposed between the second and third ends of the second sleeve, wherein the second and fourth ends of the second sleeve are coupled to the body portion, the fourth end of the second sleeve coupled to the second lateral flap, and wherein the fifth end of the second sleeve is coupled to the sixth end of the second sleeve; and a neck collar that is disposed at a neck end of the body portion, the neck collar coupled to the body portion, the first end of the first sleeve, and the first end of the second sleeve, and wherein the neck collar being selectively closable and selectively openable, wherein the neck collar, the third end of the first sleeve, the third end of the second sleeve, the first and second lateral flaps, and a portion of the proximal end of the foot pouch define an opening that is configured to leave a portion of the user's back exposed when the user wears the body cover.

8. The body cover of claim 7, wherein a front surface of the body portion comprises a polymer sheet.

9. The body cover of claim 7, further comprising a pocket that extends across a front portion of the body portion, wherein a proximal-most portion of the pocket is opened so as to define an opening between the body portion and the proximal-most portion of the pocket.

10. The item of claim 7, wherein the body portion comprises:

the first lateral flap that is configured to wrap around from a front side of the body portion and to cover a first lateral portion of at least one of: (i) a first lateral side and (ii) a first lateral back portion of the user when the user wears the body cover; and the second lateral flap that is configured to wrap around from the front side of the body portion and to cover a second lateral portion of at least one of: (a) a second lateral side and (ii) a second lateral back portion of the user when the user wears the body cover.

11. The body cover of claim 7, wherein the first and second lateral flaps do not have any fasteners that are configured to selectively couple the first and second lateral flaps together when the user wears the body cover and the lateral flaps are each moved to a medial-most position.

12. A body cover comprising:

a body portion comprising a foot pouch, a neck end, a first lateral flap, and a second lateral flap, wherein a proximal end of the foot pouch is coupled to the first and second lateral flaps;

a first lateral sleeve that is coupled to a first lateral portion of the main body portion, wherein the first sleeve comprises at least six ends, wherein the first, fifth, and sixth ends of the first sleeve each comprise a curve, wherein the first end of the first sleeve is interposed between the second and third ends of the first sleeve, wherein the second and fourth ends of the first sleeve are coupled to the body portion, the fourth end of the first sleeve coupled to the first lateral flap, and wherein the fifth end of the first sleeve is coupled to the sixth end of the first sleeve; and a second lateral sleeve that is coupled to a second lateral portion of the main body portion, wherein the second sleeve comprises at least six ends, wherein the first, fifth, and sixth ends of the second sleeve each comprise a curve, wherein the first end of the second sleeve is interposed between the second and third ends of the second sleeve, wherein the second and fourth ends of the second sleeve are coupled to the body portion, the fourth end of the second sleeve coupled to the second lateral flap, and wherein the fifth end of the second sleeve is coupled to the sixth end of the second sleeve, wherein the third end of the first sleeve, the third end of the second sleeve, the first and second lateral flaps, and a portion of the proximal end of the foot pouch define an opening in its back side when a user wears the body cover.

13. The body cover of claim 12, further comprising a neck collar that is disposed at the neck end of the body portion, the collar being selectively closable and selectively openable wherein the opening is further defined by a perimeter of a portion of the neck collar.

14. The body cover of claim 13, wherein the first and second lateral flaps do not have any fasteners that are configured to selectively couple the first and second lateral flaps together when the user wears the body cover and the lateral flaps are each moved to a medial-most position.

15. The body cover of claim 12, wherein a front surface of the body portion comprises a polymer sheet.

* * * * *